US009624944B2

(12) United States Patent
Ojeda

(10) Patent No.: US 9,624,944 B2
(45) Date of Patent: Apr. 18, 2017

(54) BLADELESS FAN

(71) Applicant: Sunbeam Products, Inc., Boca Raton, FL (US)

(72) Inventor: Carlos Ojeda, Boynton Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 329 days.

(21) Appl. No.: 14/358,814

(22) PCT Filed: Nov. 28, 2012

(86) PCT No.: PCT/US2012/066702

§ 371 (c)(1),
(2) Date: May 16, 2014

(87) PCT Pub. No.: WO2013/082058

PCT Pub. Date: Jun. 6, 2013

(65) Prior Publication Data

US 2014/0328671 A1 Nov. 6, 2014

Related U.S. Application Data

(60) Provisional application No. 61/563,952, filed on Nov. 28, 2011.

(51) Int. Cl.
*F04D 5/00* (2006.01)
*F04D 29/42* (2006.01)
(Continued)

(52) U.S. Cl.
CPC ..... *F04D 29/422* (2013.01); *F04D 17/04* (2013.01); *F04D 25/084* (2013.01);
(Continued)

(58) Field of Classification Search
CPC .... F04D 29/005; F04D 29/545; F04D 29/422; F04D 17/04; F04D 25/084;
(Continued)

(56) References Cited

U.S. PATENT DOCUMENTS 7,699,580 B2 * 4/2010 Lasko ..... F24H 3/0417 415/102
7,785,064 B2 8/2010 Bartholmey et al.
2010/0226750 A1 * 9/2010 Gammack ..... F04F 5/16 415/90

FOREIGN PATENT DOCUMENTS

JP 4118316 7/2008
JP 2010-203445 9/2010
(Continued)

*Primary Examiner* — Phutthiwat Wongwian
*Assistant Examiner* — Kelsey Stanek
(74) *Attorney, Agent, or Firm* — Seth M. Blum

(57) ABSTRACT

A bladeless fan assembly is provided which includes a housing having an air inlet and an air outlet. A blower is located within the housing, and includes a motor for driving an air stream between the air inlet and air outlet of the housing. A directional scoop is affixed to the housing at the air outlet. The directional scoop including a first end, connected to the housing at the air inlet, and a second open end opposite the first end. The first end and second open end of the directional scoop define a longitudinal length "L" of the directional scoop having a longitudinal axis "X." The directional scoop is arcuate is shape, being curved along the longitudinal axis between the first and the second open end, and about the longitudinal axis to define an open channel along the length of the directional scoop.

18 Claims, 8 Drawing Sheets

(51) Int. Cl.

| | |
|---|---|
| ***F04D 29/00*** | (2006.01) |
| ***F04D 25/08*** | (2006.01) |
| ***F04D 29/54*** | (2006.01) |
| ***F04D 17/04*** | (2006.01) |
| ***F24H 3/02*** | (2006.01) |

(52) U.S. Cl.
CPC ..... *F04D 29/005* (2013.01); *F04D 29/545* (2013.01); *F24H 3/022* (2013.01)

(58) Field of Classification Search
CPC ..... F04D 29/4206; F04D 29/4213; F04D 29/4226; F04D 29/441; F04D 29/54; F04D 29/547; F24H 3/022; F05D 2250/52
USPC ..... 415/126, 203, 98, 102, 121.3, 125, 204, 415/206, 53.1–53.3, 121.2, 212.1; 392/366; 416/100, 146 R, 247 R; 417/423.14
See application file for complete search history.

(56) References Cited

FOREIGN PATENT DOCUMENTS

| | | | |
|---|---|---|---|
| KR | 10-1998-0089845 | | 10/1998 |
| KR | 1019980059845 | * | 10/1998 |

* cited by examiner

BLADELESS FAN

FIELD OF THE INVENTION

The present invention relates to a portable electric fan and more particularly to an electric fan having a directional scoop for channeling the airflow.

BACKGROUND OF THE INVENTION

Conventional fans are typically available in two types, bladed fans having a set of exposed rotating blades, and a floor standing tower type fans having enclosed vanes mounted for rotation about an axis. Each of these has a drive apparatus for rotating the set of blades to generate an air flow. The resulting rotation of which creates a concentrated air flow directed at a user or area to cause a cooling effect.

These types of fans are available in a variety of shapes and sizes, including pedestal fans, desk top fans, ceiling fans and the like. An oscillating mechanism may also be employed to rotate the output from the fans so that the air flow is swept over a wide area of a room.

SUMMARY OF THE INVENTION

The present disclosure is directed to a bladeless fan assembly. The bladeless fan assembly includes a housing having an air inlet and an air outlet. A blower is located within the housing, and includes a motor for drive an air stream between the air inlet and air outlet of the housing A directional scoop is affixed to the housing at the air outlet. The directional scoop including a first end, connected to the housing at the air outlet, and a second open end opposite the first end. The first end and second open end of the directional scoop define a longitudinal length "L" of the directional scoop having a longitudinal axis "X." The directional scoop is arcuate in shape, being curved along the longitudinal axis between the first and the second open end, and about the longitudinal axis to define an open channel along the length of the directional scoop.

The open channel can have a first width "W1" at the first end and a second width "W2" at the second open end. It is contemplated that the first width "W1" and the second width "W2" are equal. Alternatively, the first width "W1" can be greater than the second width "W2".

The open channel can further have a first radius of curvature at the first end and extending to a second radius of curvature at the second open end. It is contemplated that the first radius of curvature and the second radius of curvature are equal. Alternatively, the first radius of curvature can be less than the second radius of curvature.

In use, air is drawn into the housing through air inlet, which in turn enters the blower. The blower accelerates the air, creating an accelerated stream of air through the housing. The accelerated airstream exists the housing though the air outlet, into the open channel of the directional scoop.

Once in the directional scoop, the accelerated air stream is further accelerated as it travels thought the open channel, being exhausted though the open end. The acceleration of the airstream through the open channel creates a pressure differential between the air stream and the air adjacent the open channel. This pressure differential creates a secondary air circulation adjacent the open channel, drawing air into the secondary circulation and expelling it adjacent to the accelerated air stream exiting the open end of the directional scoop.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
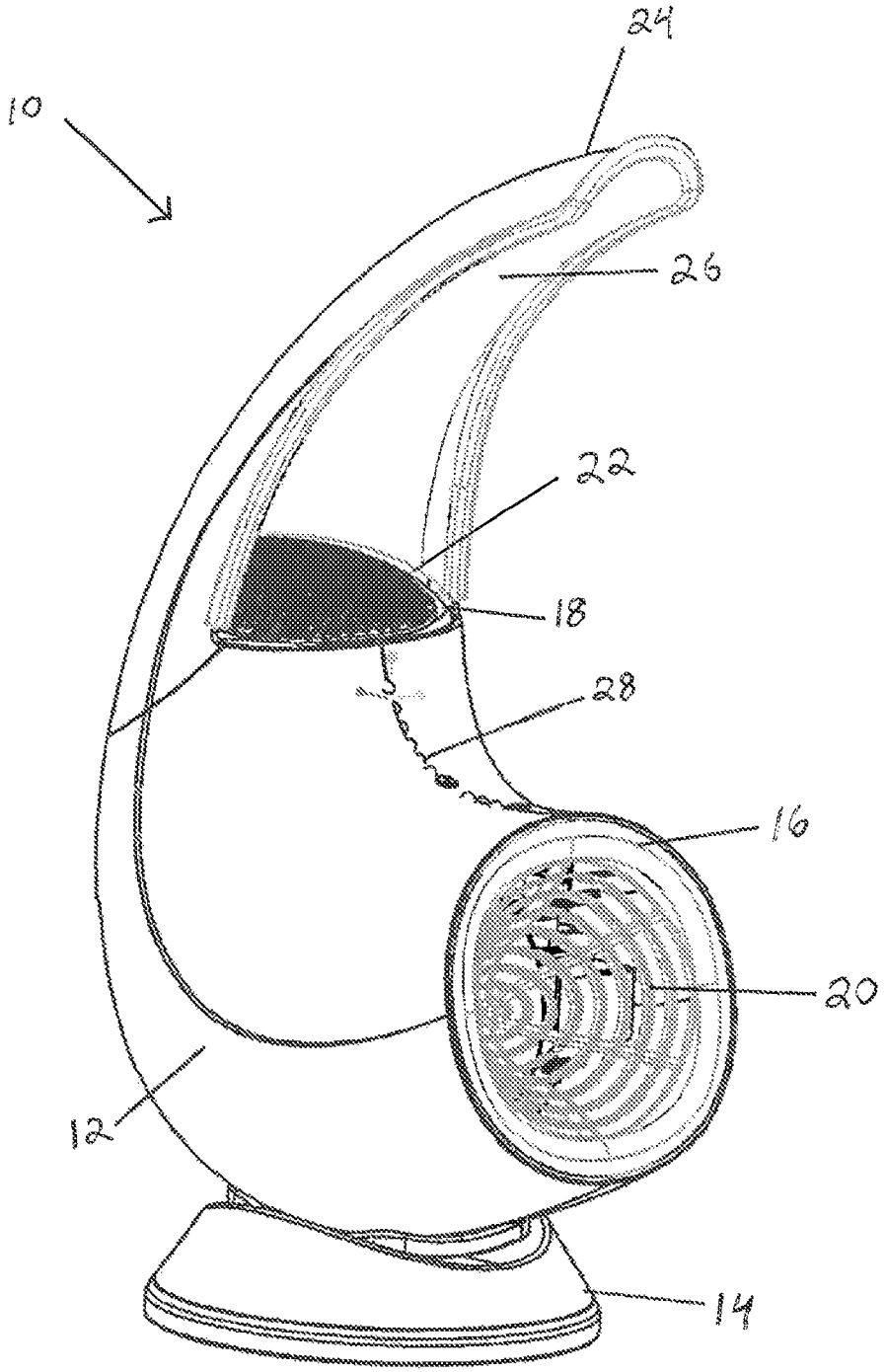
FIG. 1 depicts a front isometric view of the fan of the present discloser.

Referring now to the drawing figures in which like reference designators refer to like elements, there is shown in FIG. 1 a bladeless fan 10 of the present disclosure. The bladeless fan 10 includes a housing 12 mounted to a base 14. The housing has an air inlet 16 and an air outlet 18. An inlet grill 20 is mounted in the air inlet 16 and an outlet grill 22 is mounted in the air outlet 18. A directional scoop 24 is mounted to the air outlet 18, the directional scoop 24 defining an open channel 26 through which the outputted air travels. A control panel 28 is integrated into a top surface of the housing 10, the control panel 28 can include a controller with a plurality of inputs to control the velocity of the outputted air.

Figure 2:
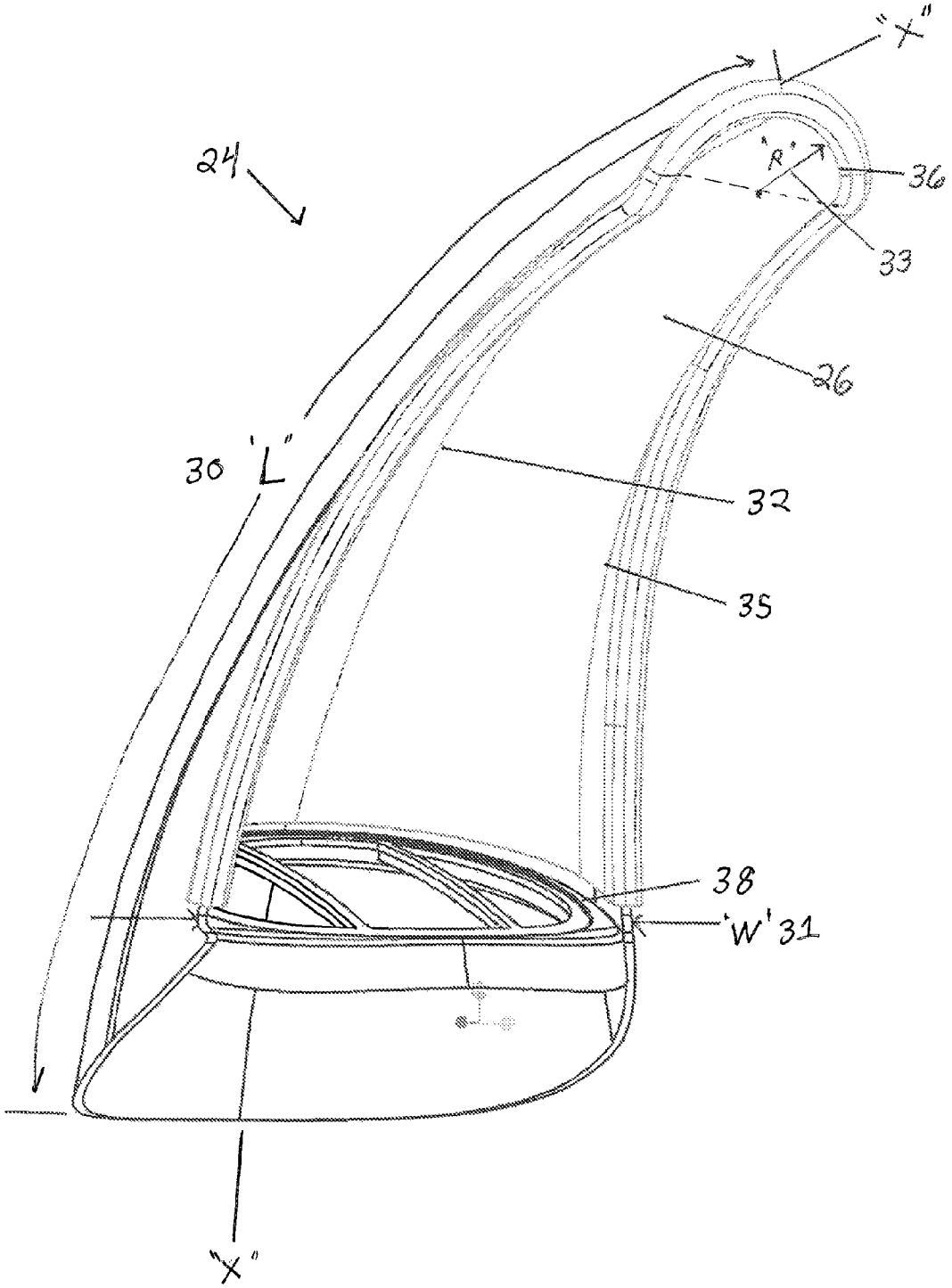
FIG. 2 depicts a front isometric view of the directional scoop of the present disclosure.

Referring to FIG. 2, the directional scoop 24 is arcuate in shape having a longitudinal length "L," defining a longitudinal axis "X". The directional scoop 24 is curved along the longitudinal axis "X" 30 and about the longitudinal axis "X" 32 defining an inner surface 34 and having an open face 35. The curved shapes 30 and 32 of the inner surface 34 of the directional scoop 24 define the open channel 26 through which the outputted air travels. The directional scoop 24 is shaped such that the outputted air travels as a laminar flow along the inner surface 34, being outputted through an open end 36 of the directional scoop 24. The directional scoop 24 can have a uniform width "W" 31 and radius of curvature "R" 33 along its length "L" 30, defining a uniform channel 26.

Figure 3:
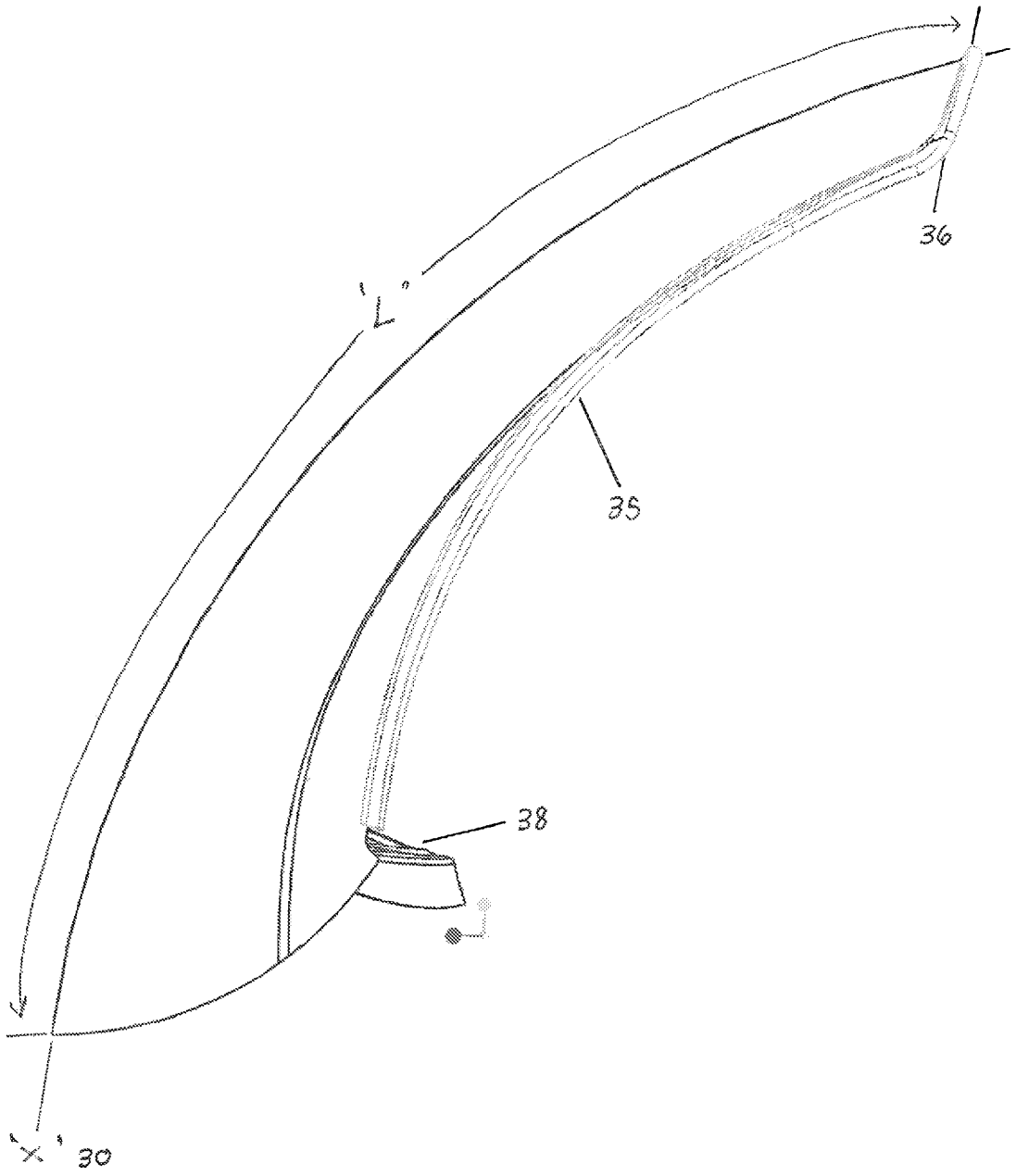
FIG. 3 depicts a side view of the directional scoop of the present disclosure
Figure 4:
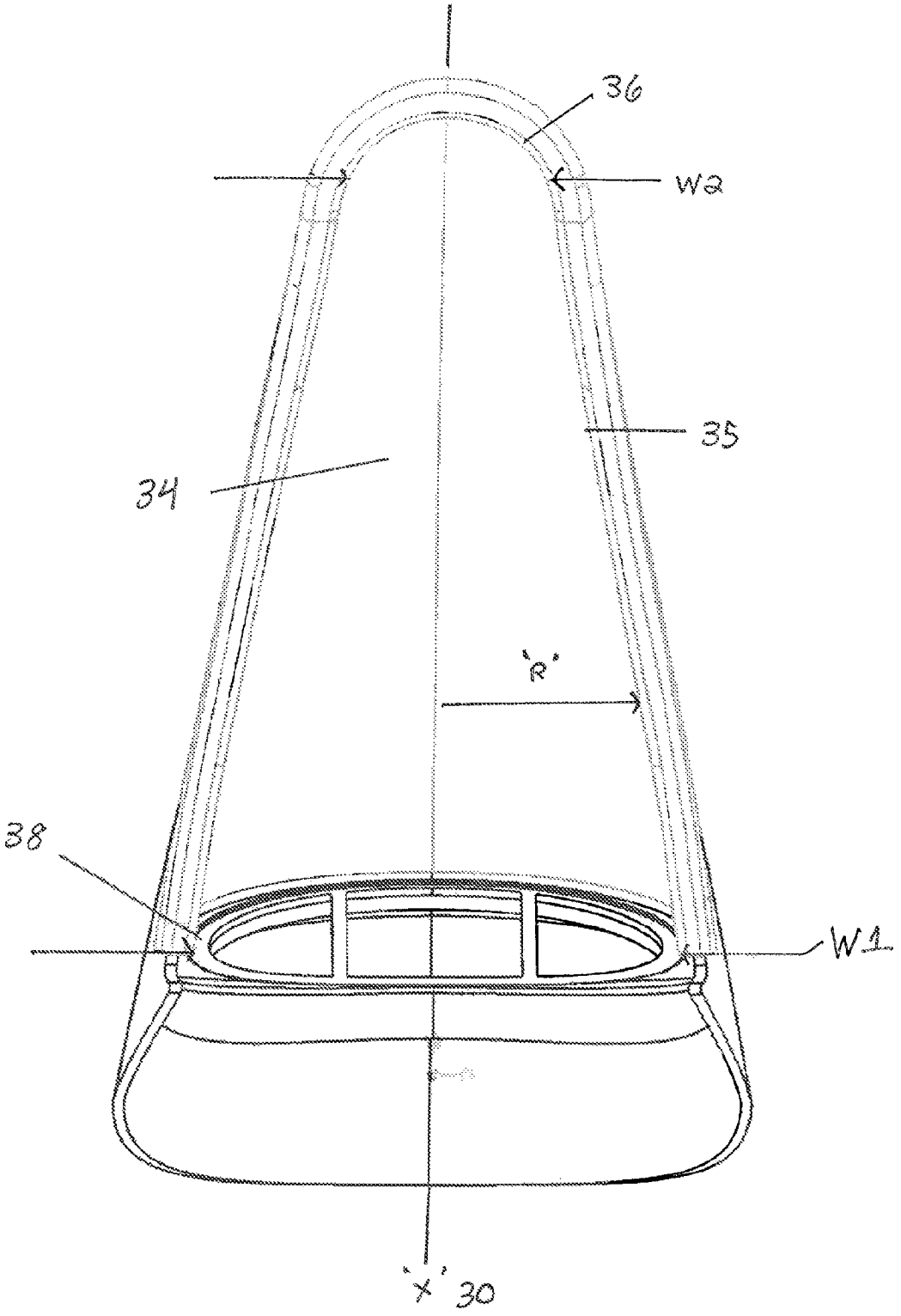
FIG. 4 depicts a front view of the directional scoop of the present disclosure.

Referring to FIGS. 3 and 4, the directional scoop 24 can have a first width "W1" at a first end 38, adjacent to the housing air outlet 18, and a second width "W2" at the open end 36, where the first width "W1" is greater the second width "W2." In this manner, the width of the open channel 26 decreases from the first end 38 to the open end 36, such that the air travelling though the open channel 26 is simultaneously compressed and accelerated though the open channel 26 as it travels from the first end 38 through to the open end 36.

Additionally, the radius of curvature "R" of the open channel 26 can increase from the first end 38 to the open end 36. The increasing radius of curvature "R" can provide a flattening effect, a farther compression, of the air flow as it travels through the open channel 26.

Figure 5:
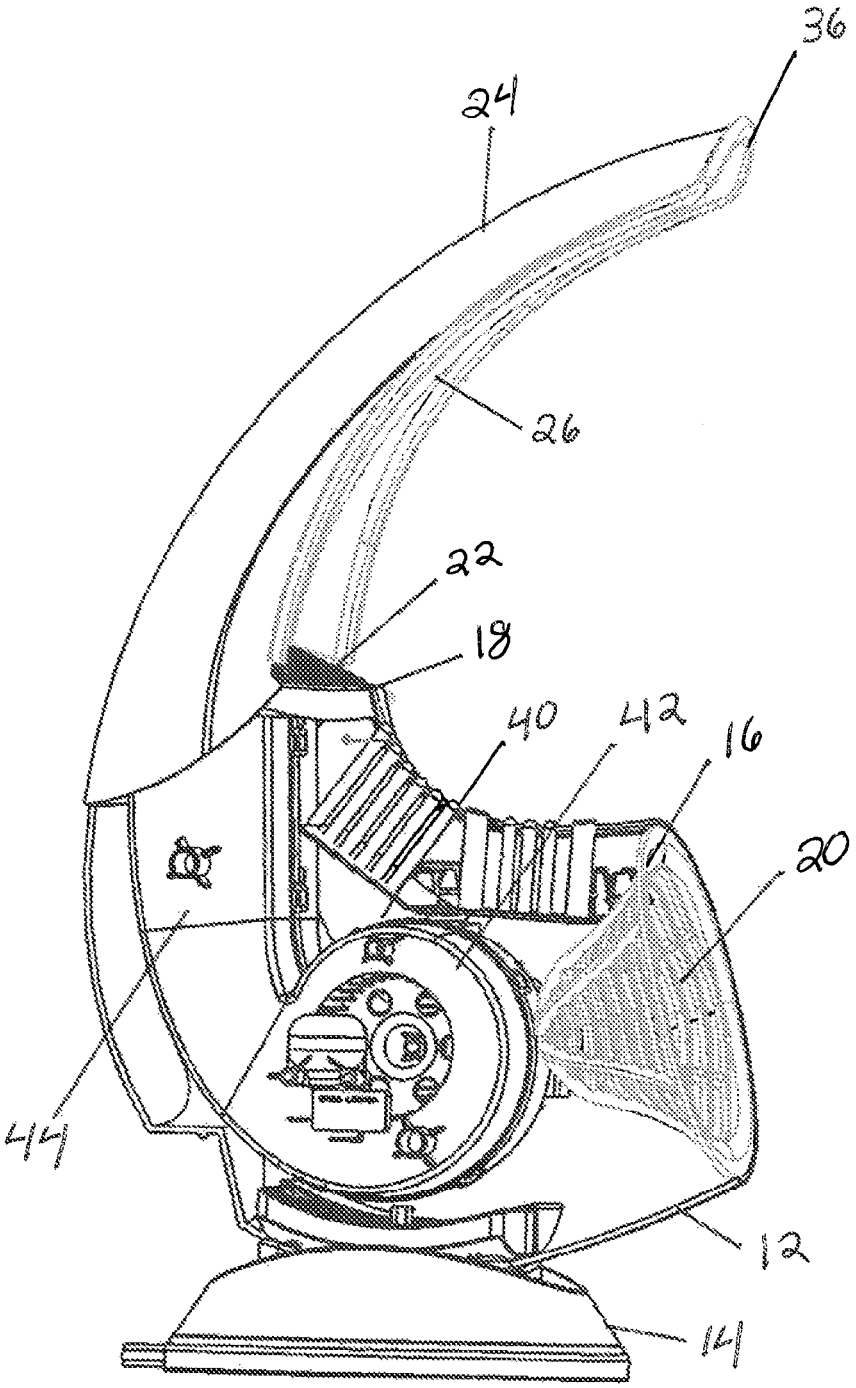
FIG. 5 depicts a partial sectional view of the fan of the present discloser.
Figure 6:
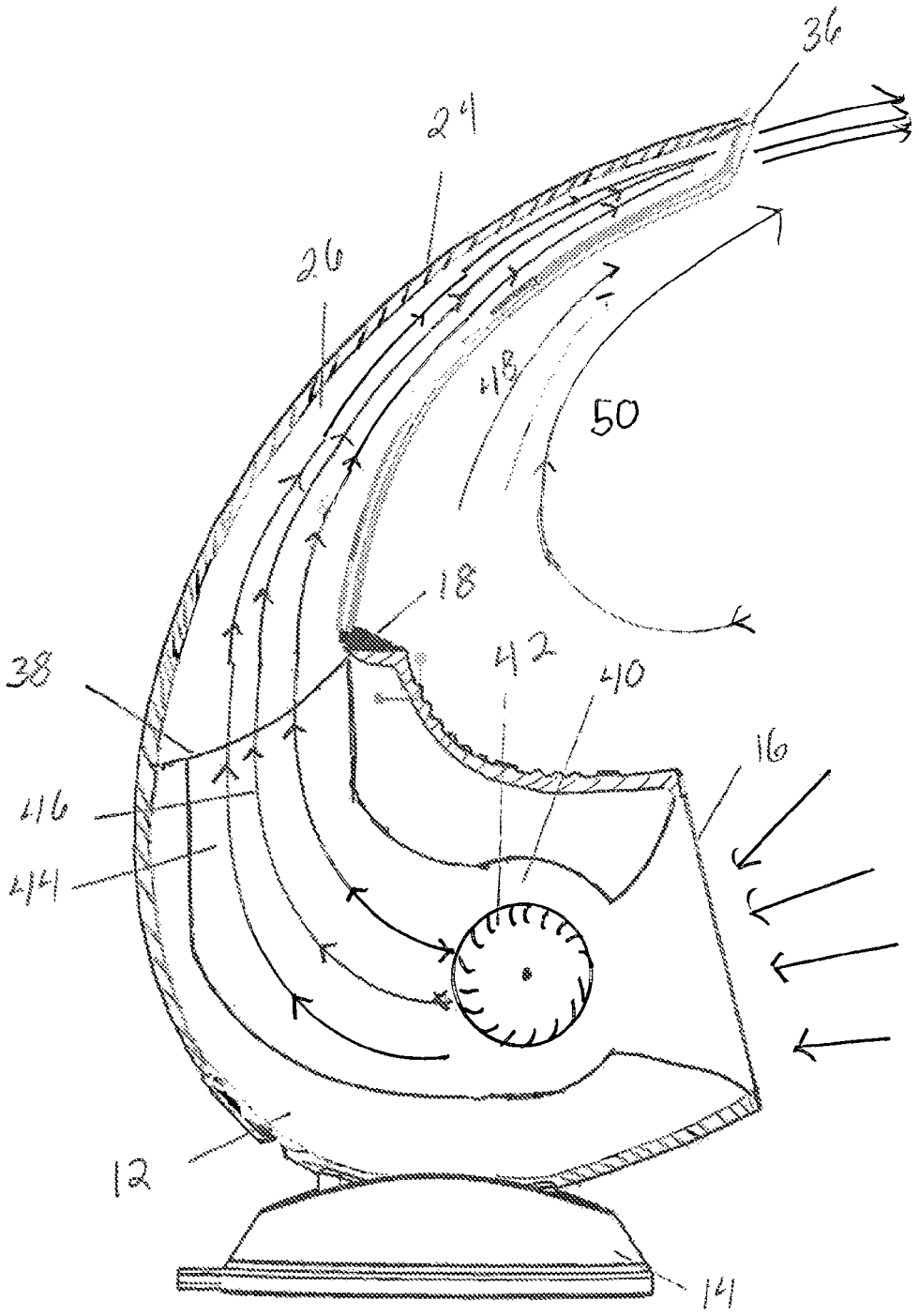
FIG. 6 depicts a schematic view of the air flow though the fan of the present discloser.

Referring to FIGS. 5 and 6, the housing defines an interior space 40 in which an air circulator 42 is positioned. The air circulator 42 can take the form of an axial fan, transverse blower, or non-transverse blower connected to a motor. The air circulator 42 is positioned within the housing and includes an air plenum 44 connected to the air outlet 18. A power cord (not shown) fitted with a power plug extends from the housing 12, supplying electrical power from a household electrical receptacle to the fan 10.

Air is drawn into the housing 12 through air inlet 16, which in turn enters the air circulator 42. The air circulator 42 accelerates the air, creating an accelerated stream of air 46 through the plenum 44. The accelerated airstream 46 exists the plenum 44 though the air outlet 18, into the open channel 26 of the directional scoop 24.

Once in the directional scoop 24, the accelerated air stream 46 is further accelerated as it travels thought the open channel 26, being exhausted though the open end 36. The acceleration of the airstream 46 through the open channel 26 creates a pressure differential between the air stream 46 and the air 48 adjacent the open channel 26. This pressure differential creates a secondary air circulation 50 adjacent the open channel 26, drawing air into the secondary circulation 50 and expelling it adjacent to the accelerated air stream 46 exiting the open end 36 of the directional scoop 24.

In the above. FIGs. the air circulator is depicted as a blower mounted transverse to the air inlet 16, however as noted above, it is contemplated that the air circulator 42 can take the form of an axial fan, transverse blower, or non-transverse blower.

It is further noted the air inlet 16 is depicted as being positioned at a front portion of the housing 12. However, it is contemplated that the air inlet 16 can be positioned on one or both sides of the housing 12, or at the back of the housing 12.

Figure 7:
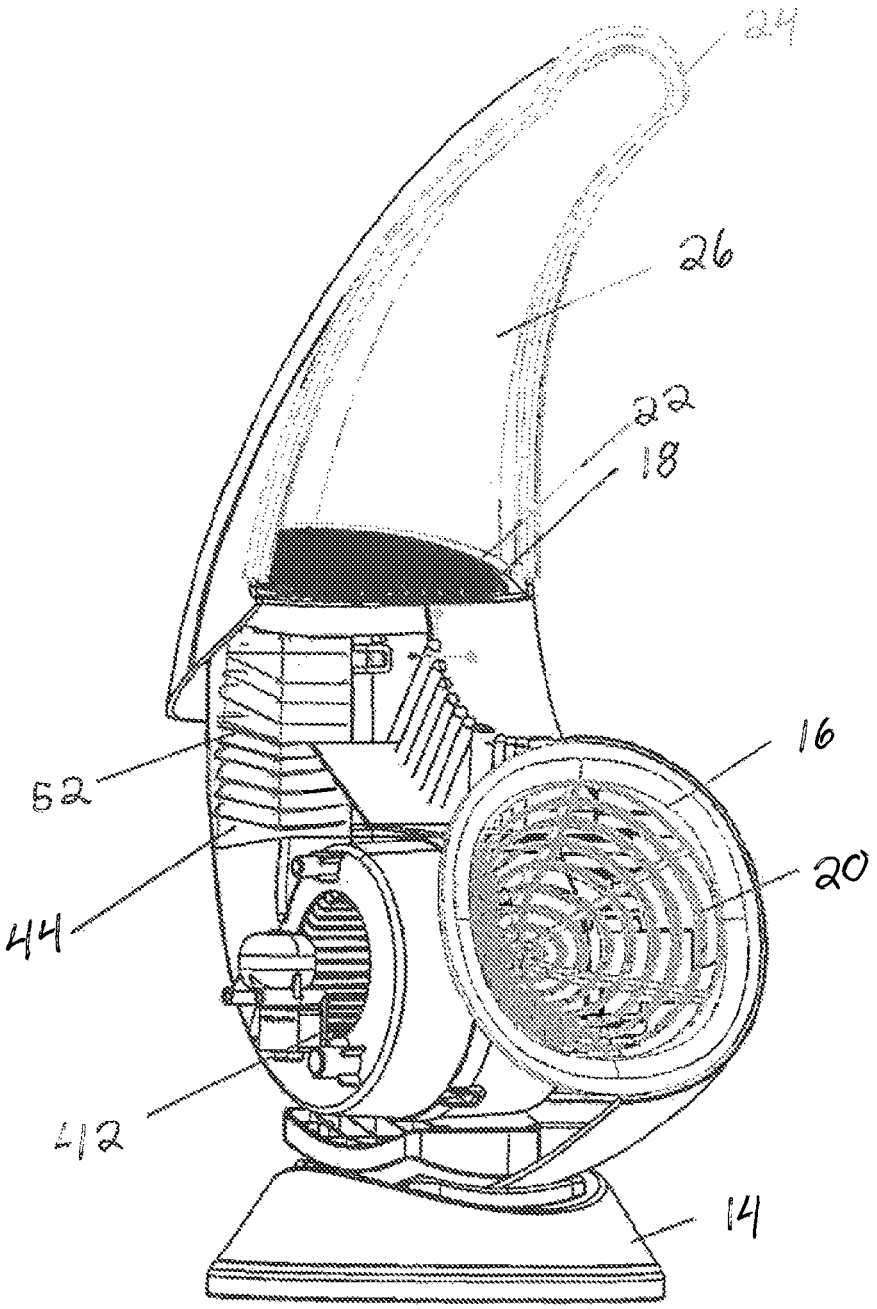
FIG. 7 depicts a heating element positioned within the plenum of the fan.

Referring to FIG. 7, a heating element 52 connected to a power supply can be mounted in the plenum 44 to convert the fan 10 into a heater which can be used to create either a cooling air stream or a warming air stream as required by the user. In use, air is drawn into the housing 12 through air inlet 16, which in turn enters the air circulator 42. The air circulator 42 accelerates the air, creating an accelerated stream of air 46 through the plenum 44. The heat element 52 heats the accelerated air stream 46 as is travels through the plenum 44. The heated accelerated airstream 46 exists the plenum 44 though the air outlet 18, into the open channel 26 of the directional scoop 24.

Once in the directional scoop 24, the heated accelerated air stream 46 is further accelerated as it travels thought the open channel 26, being exhausted though the open end 36.

Figure 8:
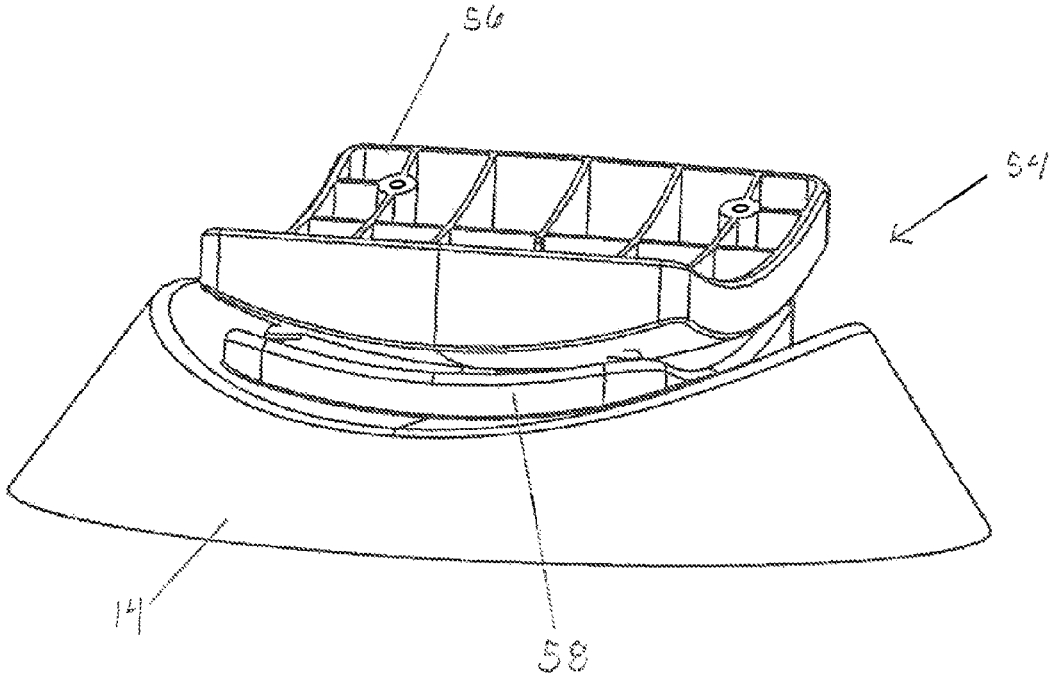
FIG. 8 depicts a tilting mechanism of the present disclosure.

Referring to FIG. 8, the fan 10 can further include a tilting mechanism 54, allowing the fan to be positioned between a first fully tilted portion and a second fully tilted position. The tilting mechanism 54 can include a first curved plate 56 mounted to a bottom portion of the housing 12. A second curved plate 58 is mounted to the base 14, where the plates 56 and 58 are configured to be slidable with respect to each other allowing the housing 12 to be tilted with respect to the base 14.

The base on the fan can further include an oscillation mechanism which rotates the fan output about a central axis. The oscillation mechanism can include a motor positioned in the base 14. The power cord, extending through the base 14, is used to provide electrical power to motor. A shaft extends from the motor through the base 14, being connected to the housing 12. The motor causes the shaft to rotate, in a periodic fashion, resulting in a periodic, oscillation, rotation of the base 12.

The oscillation motor can be connected to the controller, which can control the range and speed of the oscillations. In this manner, the output from the fan 10 can be periodically rotated about a central axis. The range of each oscillation of the housing 12 can be between 60° and 120°. Additionally, the oscillating mechanism can be utilized to control the speed of the tier example at about 3 to 5 oscillations per minute.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A fan assembly comprising:

a housing having an air inlet and an air outlet;

a blower located within the housing;

a directional scoop comprises a first end affixed to the housing at the air outlet and a second end opposite the first end, wherein the directional scoop is curved and defines an open channel from the first end to the second end where air stream in the open channel creates a pressure differential with air adjacent the open channel;

an inlet grill positioned in the air inlet; and an outlet grill positioned in the air outlet, wherein the outlet grill is positioned between the air outlet and the directional scoop.

2. A fan assembly as set forth in claim 1, wherein the blower is positioned between the air inlet and the air outlet, drawing air through the housing.

3. A fan assembly as set forth in claim 2, wherein the blower comprises a motor and a power cable connected to the motor through housing.

4. A fan assembly as set forth in claim 1, further comprising a heater positioned within the housing.

5. A fan assembly as set forth in claim 4, wherein the heater is adjacent the air outlet.

6. A fan assembly as set forth in claim 1, further comprising a base, wherein the housing is affixed to the base.

7. A fan assembly as set forth in claim 6, further comprising a tilt mechanism interposed between the housing and the base.

8. A fan assembly comprising:

a housing having an air inlet and an air outlet;

a blower located within the housing;

a directional scoop affixed to the housing at the air outlet; wherein the directional scoop includes a first end connected to the housing at the air outlet and a second open end opposite the first end, wherein the directional scoop is curved along a longitudinal length between the first end and the second open end and the directional scoop has a curved inner surface about the longitudinal length defining an open channel from the first end to the second open end; where the air stream in the open channel creates a pressure differential with air adjacent the open channel;

an inlet grill positioned in the air inlet; and an outlet grill positioned in the air outlet, wherein the outlet grill is positioned between the air outlet and the directional scoop.

9. A fan assembly as set forth in claim 8, wherein the open channel has a first width "W1" at the first end and a second width "W2" at the second open end.

10. A fan assembly as set forth in claim 9, wherein the first width "W1" is equal to the second width "W2".

11. A fan assembly as set forth in claim 9, wherein the first width "W1" is greater than the second width "W2".

12. A fan assembly as set forth in claim 9, wherein the open channel has a first radius of curvature at the first end and a second radius of curvature at the second open end.

13. A fan assembly as set forth in claim 12, wherein the first radius of curvature is equal to the second radius of curvature.

14. A fan assembly as set firth in claim 12, wherein the first radius of curvature is less than the second radius of curvature.

15. A fan assembly comprising:

a housing having an air inlet and an air outlet;

a blower located within the housing;

an inlet grill positioned in the air inlet;

an outlet grill positioned in the air outlet; and a directional scoop affixed to the housing at the air outlet, the directional scoop including a first end connected to the housing at the air outlet, and a second open end opposite the first end defining a longitudinal length having a longitudinal axis, wherein the directional scoop is curved along the longitudinal axis from the first end to the second open end, and is curved about the longitudinal axis to define an open channel, where air stream in the open channel creates a pressure differential with air adjacent the open channel;

wherein the open channel has a first width "W1" at the first end and a second width "W2" at the second open end, and wherein the open channel has a first radius of curvature at the first end and a second radius of curvature at the second open end, and wherein the outlet grill is positioned between the air outlet and the directional scoop.

16. A fan assembly as set forth in claim 15, wherein the first width "W1" is greater than the second width "W2".

17. A fan assembly as set forth in claim 15, wherein the first radius of curvature is less than the second radius of curvature.

18. A fan assembly as set forth in claim 15, further comprising a heater positioned within the housing.

* * * * *